US006663093B2

(12) United States Patent
Yonezawa et al.

(10) Patent No.: US 6,663,093 B2
(45) Date of Patent: Dec. 16, 2003

(54) ROTARY CLAMP

(75) Inventors: Keitaro Yonezawa, Kobe (JP); Hideaki Yokota, Kobe (JP); Yosuke Haruna, Kobe (JP)

(73) Assignee: Kabushiki Kaisha Kosmek, Hyogo (JP)

( * ) Notice: Subject to any disclaimer, the term of this patent is extended or adjusted under 35 U.S.C. 154(b) by 0 days.

(21) Appl. No.: 10/292,680

(22) Filed: Nov. 12, 2002

(65) Prior Publication Data

US 2003/0090047 A1 May 15, 2003

(30) Foreign Application Priority Data

Nov. 13, 2001 (JP) ..... P 2001-346977
Dec. 18, 2001 (JP) ..... P 2001-383987
Apr. 3, 2002 (JP) ..... P 2002-100851

(51) Int. Cl.[7] ..... B23Q 3/08
(52) U.S. Cl. ..... 269/24; 269/32; 269/27
(58) Field of Search ..... 269/32, 24, 27, 269/228

(56) References Cited

U.S. PATENT DOCUMENTS 4,351,516 A * 9/1982 Ersoy et al. ..... 269/27
4,508,327 A * 4/1985 Ersoy ..... 269/23
5,013,015 A * 5/1991 Fatheree ..... 269/24
5,192,058 A 3/1993 VanDalsem et al.
5,820,118 A 10/1998 Craft
5,927,700 A 7/1999 Yonezawa
5,954,319 A * 9/1999 Yonezawa ..... 269/24
6,113,086 A * 9/2000 Yonezawa ..... 269/24

* cited by examiner

*Primary Examiner*—Lee D. Wilson
(74) *Attorney, Agent, or Firm*—Akin, Gump, Strauss, Hauer & Feld, L.L.P.

(57) ABSTRACT

A clamp rod (5) is inserted into a housing (3) rotatably around an axis and movably downwards for clamping. The clamp rod (5) has an outer peripheral portion formed with three guide grooves (26) which are arranged peripherally at substantially the same spacing. An engaging ball (29) which is fitted into every guide groove (26) is supported by a lower end wall (3*b*) of the housing (3). Each of the guide grooves (26) comprises a rotary groove (27) and a straight groove (28) which is in upward continuity with the rotary groove (27). The rotary grooves (27) as well as the straight grooves (28) are arranged in parallel with one another. A partition wall between the adjacent guide grooves (26), (26) has a minimum thickness (T) set to a value smaller than a diameter (D) of the engaging ball (29).

17 Claims, 12 Drawing Sheets

ROTARY CLAMP

BACKGROUND OF THE INVENTION

1. Field of the Invention

The present invention relates to a clamp of the type that rotates a clamp rod.

2. Explanation of Related Art

There is a conventional technique of the rotary clamp of this type which is constructed in the following manner, as disclosed in U.S. Pat. No. 5,820,118.

A clamp rod is inserted into a cylinder tube rotatably around an axis and axially movably. The clamp rod has a halfway height portion in an outer periphery of which there are provided oppositely inclining two helical grooves and a straight groove. An engaging ball is fitted into any one of these three grooves. The engaging ball is supported by a recess provided in a barrel portion of the cylinder tube.

The conventional technique has the following problem.

The clamp rod is supported by the cylinder tube through one engaging ball. Therefore, the clamp rod slightly inclines when it is driven for clamping and for unclamping. This reduces the accuracy of placing a clamp member provided at a leading end of the clamp rod, at a clamping position and at an unclamping position.

SUMMARY OF THE INVENTION

The present invention aims at preventing the inclination of the clamp rod.

In order to achieve the above aim, for example, as shown in FIGS. 1 to 6 or in FIGS. 7 to 10, the present invention has constructed a rotary clamp in the following manner.

A clamp rod 5 is inserted into a housing 3 rotatably around an axis and movably for clamping from one end to the other end in an axial direction. The clamp rod 5 has an outer peripheral portion formed with a plurality of guide groove 26 peripherally. The housing 3 supports a plurality of engaging members 29 which are fitted into these guide grooves 26, respectively. Each of the guide grooves 26 comprises a rotary groove 27 and a straight groove 28 provided in continuity with each other from the other end to the one end in the axial direction. The rotary grooves 27 as well as the straight grooves 28 are arranged in parallel with one another. A partition wall between the adjacent guide grooves 26, 26 has a minimum thickness (T) set to a value smaller than a groove width (W) of the guide groove 26.

The present invention offers the following advantages.

The clamp rod is provided with the guide grooves into which the engaging members are fitted, respectively. This enables the housing to peripherally and substantially evenly support the clamp rod through the engaging members. Therefore, the clamp rod can be prevented from inclining when it is driven for clamping and for unclamping. This results in improving the accuracy of placing a clamp member provided at a leading end of the clamp rod, at a clamping position and at an unclamping position.

Further, the partition wall between the adjacent guide grooves has the minimum thickness set to the value smaller than the groove width of the guide groove. Therefore, it is possible to provide many guide grooves in the clamp rod so as to support the clamp rod peripherally and substantially evenly and at the same time to decrease an inclination angle of the rotary groove. This reduces the stroke required for rotating the clamp rod to result in making the rotary clamp compact. Besides, it becomes possible to arrange a plurality of engaging members, each of which has a large diameter, adjacent one another. Therefore, a rotary mechanism of the clamp can endure a large rotation torque to result in increasing its service lifetime.

The present invention includes a clamp in which the engaging member is formed from a ball. This invention can more smoothly rotate the clamp rod and increase the service lifetime of the rotary mechanism.

Further, in order to accomplish the foregoing object, the present invention has constructed a rotary clamp in the following manner, for example, as shown in FIGS. 1 to 6.

A clamp rod 5 is inserted into a housing 3 rotatably around an axis and movably for clamping from one end to the other end in an axial direction. The clamp rod 5 has an outer peripheral portion formed with a plurality of guide grooves 26 peripherally. The housing 3 supports a plurality of engaging balls 29 which are fitted into the guide grooves 26, respectively. Each of the guide grooves 26 comprises a rotary groove 27 and a straight groove 28 provided in continuity with each other from the other end to the one end in the axial direction. The rotary grooves 27 as well as the straight grooves 28 are arranged in parallel with one another. A partition wall between the adjacent guide grooves 26, 26 has a minimum thickness (T) set to a value smaller than a diameter (D) of the engaging ball 29.

This invention also offers the same advantages as those of the above-mentioned invention.

The clamp rod can be prevented from inclining when it is driven for clamping and for unclamping. This results in improving the accuracy of placing a clamp member provided at a leading end of the clamp rod, at a clamping position and at an unclamping position. In addition, it is possible to reduce the stroke required for rotating the clamp rod, which leads to the possibility of making the rotary clamp compact. Besides, it becomes possible to arrange a plurality of engaging balls, each of which has a large diameter, adjacent one another. Therefore, a rotary mechanism of the clamp can endure a large rotation torque to result in increasing its service lifetime.

The present invention, for example, as shown in FIGS. 1 to 4 or in FIGS. 7 to 10, includes the following clamp.

The engaging balls 29 are rotatably supported by through holes 31 provided in the housing 3 and a sleeve 35 is rotatably and externally fitted over the engaging balls 29. This invention offers the following advantage.

When the clamp rod rotates, almost only rolling friction acts between an inner peripheral surface of the sleeve and the engaging balls, but sliding friction hardly acts therebetween. This reduces a resistance which acts from the sleeve to the engaging balls to result in decreasing a frictional force which acts from the engaging balls to the rotary grooves and therefore smoothly rotating the clamp rod with a light force.

The present invention also includes a clamp which is provided with at least three guide grooves. This invention is preferable due to the fact that it supports the clamp rod peripherally and substantially evenly and decreases the inclination angle of the rotary groove.

The present invention further includes a clamp which has the guide grooves arranged peripherally of the clamp rod at substantially the same spacing. This invention is preferable for supporting the clamp rod more evenly.

Moreover, the present invention, for instance, as shown in FIG. 4, FIG. 5 or FIG. 6, includes the following clamp.

The clamp rod 5 has the other end potion provided with the above-mentioned guide grooves 26. Each of the guide grooves 26 includes the rotary groove 27 provided at its other end portion with a stopper wall 45 which receives the engaging member or ball 29. The stopper wall 45 has a receiving surface 45*a* which fits with the engaging member or ball 29. This invention offers the following advantage. When the clamp rod rotates and retreats, the receiving surface of the stopper wall fits with the engaging member or ball to inhibit the clamp rod from rotating. This results in stopping the rotation of the clamp rod with a high accuracy.

Besides, the present invention, for example, as shown in FIG. 1, includes the following clamp. An annular piston 15 is inserted into the housing 3 axially movably. The clamp rod 5 is inserted into the piston 15. A radial bearing 24 is arranged between the piston 15 and the clamp rod 5. This invention offers another advantage of more smoothly rotating the clamp rod.

BRIEF DESCRIPTION OF THE DRAWINGS

FIG. 1 is a partial sectional view of a rotary clamp when seen in elevation;

FIG. 2 is a sectional view of a rotary mechanism provided in the clamp when seen in plan;

FIG. 3 is an enlarged view of an essential portion in FIG. 1 and corresponds to a sectional view when seen along a line III—III in FIG. 2 in a direction indicated by arrows;

FIG. 4 is an enlarged and developed view of a lower slide portion provided in a clamp rod of the clamp;

FIG. 7 is a partial sectional view of the clamp when seen in elevation and is similar to FIG. 1;

FIG. 8 is a sectional view of a rotary mechanism provided in the clamp when seen in plan and is similar to FIG. 2;

FIG. 9 is an enlarged view of an essential portion in FIG. 7 and corresponds to a sectional view when seen along a line 1X—1X in FIG. 8 in a direction indicated by arrows;

FIG. 10 is an enlarged and developed view of a lower slide portion provided in a clamp rod of the clamp and is similar to FIG. 4;

DESCRIPTION OF THE PREFERRED EMBODIMENTS

Figure 1:
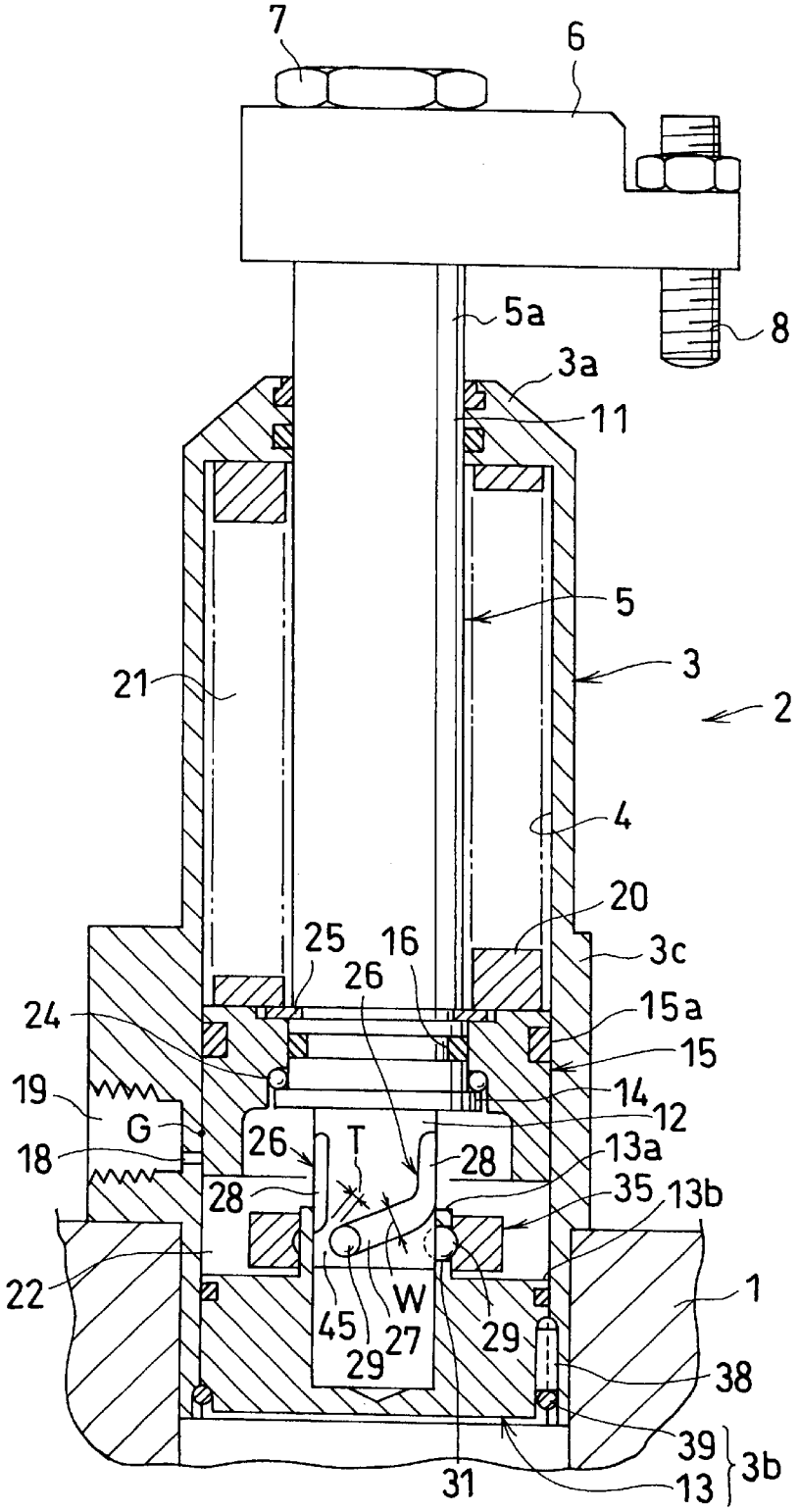
FIGS. 1 to 4 show a first embodiment of the present invention.

A first embodiment of the present invention is explained with reference to FIGS. 1 to 4. Fist, an explanation is given for a whole structure of a rotary clamp by resorting to FIG. 1. FIG. 1 is a partial sectional view of the clamp when seen in elevation.

A housing 3 of a clamp 2 is fixed to a work pallet 1 through a plurality of bolts (not shown). The housing 3 has a cylindrical hole 4 into which a clamp rod 5 is inserted. The clamp rod 5 has an upper end portion to which an arm 6 is secured at a desired rotation position by a nut 7. The arm 6 has a leading end portion to which a push bolt 8 is fixed.

The housing 3 has an upper end wall (first end wall) 3*a* which supports an upper slide portion (first slide portion) 11 provided in a rod main body 5*a* of the clamp rod 5 slidably and hermetically. Further, a support cylinder 13 forms part of a lower end wall (second end wall) 3*b* of the housing 3 and slidably supports a lower slide portion (second slide portion) 12 which projects downwards of the rod main body 5*a*. The upper slide portion 11 and the lower slide portion 12 are tightly fitted into the upper end wall 3*a* and the lower end wall 3*b*, respectively.

The lower slide portion 12 has an outer diameter set to a value smaller than that of an outer diameter of the upper slide portion 11.

A means for driving the clamp rod 5 is constructed as follows.

The clamp rod 5 is provided with an input portion 14 in the shape of a flange between the upper slide portion 11 and the lower slide portion 12. Further, an annular piston 15 is externally fitted onto the clamp rod 5 vertically movably and hermetically through a sealing member 16. The piston 15 faces the input portion 14 from above. And the piston 15 is inserted into the cylindrical hole 4 hermetically through another sealing member 15*a*.

In addition, a radial bearing 24 is arranged between the input portion 14 and the piston 15. A snap ring 25 prevents the removal of the piston 15. Here the radial bearing 24 is composed of many metal balls and can receive not only a radial force but also a vertical thrust.

A first chamber 21 for clamping is provided between the piston 15 and the upper end wall 3*a*. A clamp spring 20 made of an compressed coil spring is attached in the first chamber 21. A second chamber 22 for unclamping is provided between the piston 15 and the lower end wall 3*b*. Pressurized oil is supplied to and discharged from the second chamber 22 through a pressurized oil supply and discharge port 19 for unclamping and a restricting oil passage 18.

A fitting gap (G) between a peripheral wall of the second chamber 22 and an outer peripheral surface of the piston 15 limits supply amount of pressurized oil from the oil passage 18 to the second chamber 22 as well as discharge amount of the pressurized oil from the second chamber 22 to the oil passage 18.

A rotary mechanism is provided over the lower slide portion 12 of the clamp rod 5 and an upper portion of an inner wall 13*a* of the support cylinder 13. The rotary mechanism is constructed in the following manner as shown in FIG. 1 and FIGS. 2 to 4.

Figure 2:
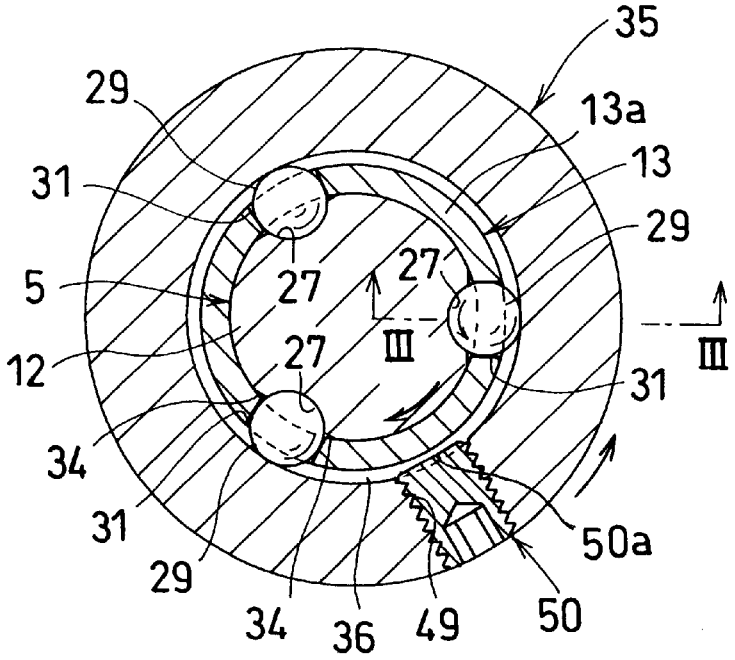
Figure 3:
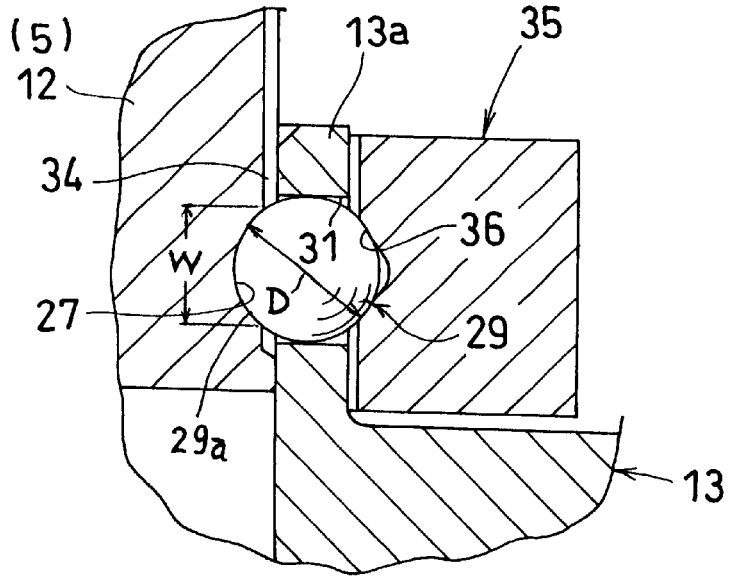
Figure 4:
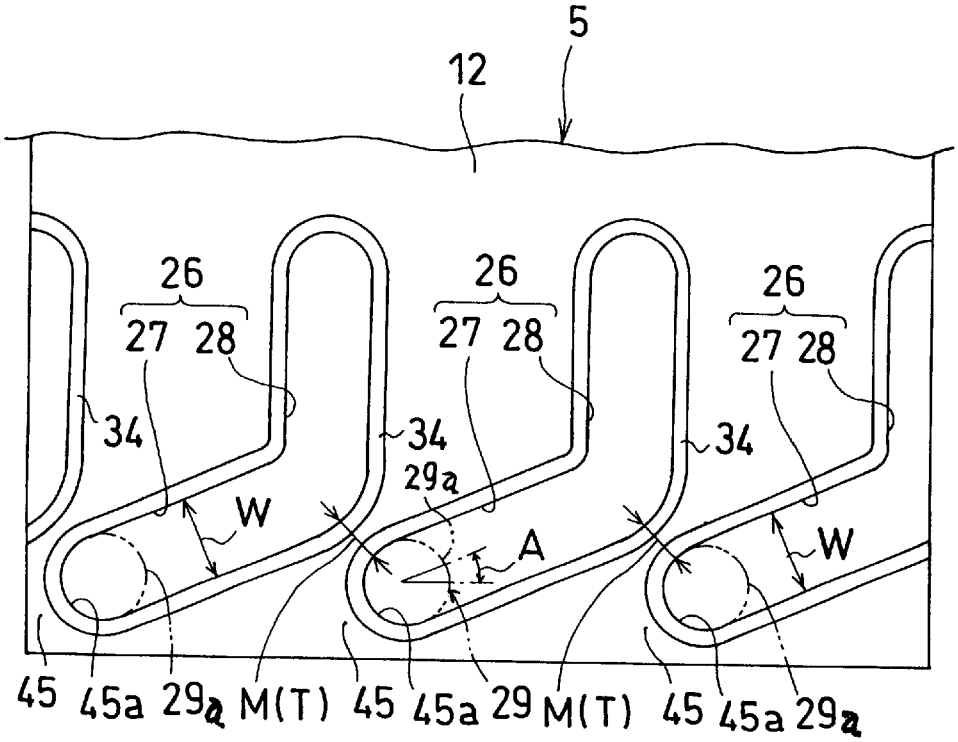

FIG. 2 is a sectional view of the rotary mechanism when seen in plan. FIG. 3 is an enlarged view of an essential portion in FIG. 1 and corresponds to a sectional view when seen along a ling III—III in FIG. 2 in a direction indicated by arrows. FIG. 4 is an enlarged and developed view of an outer peripheral surface of the lower slide portion 12.

The lower slide portion 12 has the outer peripheral surface provided with three guide grooves 26 peripherally at substantially the same spacing. Each of the guide grooves 26 is formed from a groove in the shape of an arc or a segment when seen in section. And it comprises a helical rotary groove 27 and a straight groove 28 which is in upward continuity with the helical rotary groove 27. The rotary grooves 27 as well as the straight grooves 28 are arranged in parallel with one another. As for the adjacent guide grooves 26, 26, a partition wall is minimum in thickness between a lower portion of a right rotary groove 27 and an upper portion of a left rotary groove 27 in FIG. 4. The minimum thickness (M) of the partition wall is set to a value smaller than a groove width (W) of the guide groove 26. Further, the rotary groove 27 is inclined at an angle (A) which is set to a small value within a range of about 11 degrees to about 25 degrees. In the exemplified clamp which relies on a spring force, the inclination angle (A) is preferably set to a value within a range of about 11 degrees to about 20 degrees for reducing the rotation stroke.

As such the inclination angle (A) of the helical rotary grove 27 has been made small to result in largely shortening a lead of the rotary groove 27. This decreases the stroke for rotating the clamp rod 5.

An engaging ball 29 is fitted into each of the guide grooves 26. Numeral 29*a* in FIGS. 3 and 4 designates a fitting portion of the engaging ball 29. The engaging ball 29 has a diameter (D) (see FIG. 3) set to a value larger than the minimum thickness (M) of the partition wall between the adjacent rotary grooves 27, 27. The respective engaging balls 29 are rotatably supported by three through holes 31 provided in the upper portion of the inner wall 13*a* of the support cylinder 13. A sleeve 35 is externally fitted over these three engaging balls 29 rotatably around the axis. Speaking it in more detail, the sleeve 35 has an inner peripheral surface formed with a groove 36 in the shape of a letter 'V'. The V-shaped groove 36 has two vertical points at which the engaging ball 29 can roll.

The engaging ball 29 is inserted into the through hole 31 via an internally threaded hole 49 which is provided in the sleeve 35. A closure bolt 50 is attached to the internally threaded hole 49. A projection 50*a* at a leading end of the closure bolt 50 can receive the engaging ball 29.

The rotary groove 27 has a lower end portion provided with a stopper wall 45 which receives the fitting portion 29*a* of the engaging ball 29. The stopper wall 45 has a receiving surface 45*a* which can fit with the engaging ball 29.

Besides, the guide groove 26 has an opening which is provided at its edge portion with a cutting surface 34 for preventing interference. Owing to this arrangement, even if the opening edge portion of the guide groove 26 undergoes a plastic deformation by a surface pressure of the engaging ball 29 and heaps up, it is possible to prevent the interference between the heaped-up portion and the inner wall 13*a* of the support cylinder 13. As a result, the clamp rod 5 smoothly rotates for a long period of time.

Further, as shown in FIG. 1, an outer wall 13*b* of the support cylinder 13 is attached to a barrel portion 3*c* of the housing 3 through a positioning pin 38 which extends vertically, so as to be prevented from rotating. This makes it possible to accurately determine a rotation phase of the clamp rod 5 with respect to the housing 3. The support cylinder 13 is secured to the housing barrel portion 3*c* by a lock member 39 made of a snap ring.

The rotary clamp 2 operates as follows.

In a state of FIG. 1, pressurized oil is supplied to the second chamber 22 for unclamping, thereby raising the clamp rod 5 to an illustrated rotation and retreat position.

When switching over the clamp 2 to a clamping condition, the pressurized oil in the second chamber 22 is discharged to push down the input portion 14 of the clamp rod 5 by the clamp spring 20. Then the clamp rod 5 goes down along the rotary grooves 27 while rotating in a clockwise direction when seen in plan. Subsequently, it descends straightly along the straight grooves 28. This enables the clamp rod 5 to switch over to a clamping position (not shown).

As shown by an arrow in FIG. 2, when the clamp rod 5 rotates in the clockwise direction when seen in plan, every engaging ball 29 fitted into the rotary groove 27 rolls in a counter-clockwise direction when seen in plan and at the same time the sleeve 35 externally fitted over the respective engaging balls 29 freely rotates in the counter-clockwise direction. This allows almost only rolling friction to act between an inner peripheral surface of the sleeve 35 and every engaging ball 29, but hardly allows sliding friction to act therebetween. This reduces a resistance which acts from the sleeve 35 to every engaging ball 29, which results in decreasing a frictional force which acts from every engaging ball 29 to the rotary groove 27 and therefore smoothly rotating the clamp rod 5 with a light force.

Here, the sleeve 35 has an inner diameter set to a value which is about one and half times a value of an outer diameter of the lower slide portion 12 of the clamp rod 5. Thus in the case of rotating the clamp rod 5 by 90 degrees, the sleeve 35 rotates by about 60 degrees.

When switching over the clamp 2 from the clamping condition to a rotated and retreated condition in FIG. 1, the pressurized oil is supplied to the second chamber 22 for unclamping. Then, first, the piston 15 goes up by an upward oil pressure force which acts on an annular sectional area of the piston 15. Simultaneously, the clamp rod 5 straightly ascends along the straight grooves 28 by an upward oil pressure force which acts on an inner sectional area of the sealing member 16. Subsequently, the clamp rod 5 ascends along the rotary grooves 27 while rotating in the counter-clockwise direction when seen in plan, whereby the clamp rod 5 and the arm 6 switch over to the rotation and retreat position in FIG. 1.

In this case, as mentioned above, the upward force which acts from the pressurized oil in the second chamber 22 to the piston 15 does not apply to the clamp rod 5. This prevents an excessive force from acting on the rotary grooves 27 and the engaging balls 29.

At the above time of rotating and retreating, if the clamp rod 5 rotates in the counter-clockwise direction, every engaging ball 29 and the sleeve 35 rotates in a direction opposite to the direction indicated by the arrow in FIG. 2.

Further, at the above time of rotating and retreating, as shown in FIGS. 1 and 4, the stopper wall 45 has the receiving surface 45*a* fitted with the fitting portion 29*a* of the engaging ball 29, thereby inhibiting the rotation of the clamp rod 5. This results in stopping the rotation of the clamp rod 5 with a high accuracy. Moreover, the clamp rod 5 is provided with the stopper wall 45 and therefore offers the following advantage, when compared with a case where the barrel portion 3*c* of the housing 3 is provided with the stopper wall 45.

The cylindrical hole 4 of the housing 3 need not be provided with a stepped portion for the stopper wall and therefore can be formed straight. This can facilitate the machining of the cylindrical hole 4 and besides can make the clamp spring 20 large and strong.

The first embodiment further offers the following advantages.

The clamp rod 5 is provided with the guide grooves 26, into which the engaging balls 29 are fitted, respectively. This enables the support cylinder 13 to support the clamp rod 5 peripherally and substantially evenly through the engaging balls 29. Accordingly, when driven for clamping and for unclamping, the clamp rod 5 can be prevented from inclining. This results in improving the accuracy of placing the push bolt 8 provided in the arm 6 at a clamping position and at an unclamping position.

The partition wall between the adjacent guide grooves 26, 26 has the minimum thickness (T) set to the value smaller than the groove width (W) of the guide groove 26. Consequently, many guide grooves 26 can be provided in the clamp rod 5 to result in the possibility of peripherally and substantially evenly supporting the clamp rod 5 and at the same time decreasing the inclination angle (A) of the rotary groove 27. This can reduce the stroke required for rotating the clamp rod 5 to thereby make the rotary clamp 2 compact.

The clamp rod 5 is provided with the upper slide portion (first slide portion) 11 and the lower slide portion (second slide portion) 12 outside the opposite ends of the piston 15. Therefore, notwithstanding the existence of a fitting gap of the piston 15, the two slide portions 11, 12 axially spaced apart from each other can prevent the inclination of the clamp rod 5. In consequence, the housing 3 can surely guide the clamp rod 5 with a high accuracy.

The rotary mechanism which comprises the rotary grooves 27 and the engaging balls 29 is provided between the support cylinder 13 which has the above-mentioned guiding strength, and the lower slide portion 12. Therefore, it can fully endure a rotary torque and increase its service lifetime. In addition, the engaging balls 29 are provided in the support cylinder 13, thereby enabling portions for installing the engaging balls 29 to serve as a portion for supporting the lower slide portion 12. Thus it is possible to reduce a height of the housing 3 and make the rotary clamp 2 compact.

Moreover, the lower slide portion 12 has the outer diameter set to the value smaller than that of the outer diameter of the upper slide portion 11 to result in shortening the lead of the rotary groove 27 formed in the lower slide portion 12. This further reduces the stroke for rotating the clamp rod 5 and as a result can make the rotary clamp 2 more compact. Additionally, the pressurized oil for driving the piston 15 is decreased in supply and discharge amount.

Figure 5:
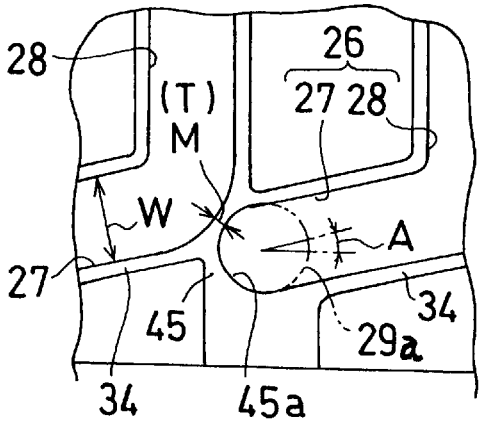
FIG. 5 shows a first modification of the first embodiment and is similar to FIG. 4.

FIG. 5 shows a first modification of the first embodiment and is similar to FIG. 4. In FIG. 5, the partition wall between the adjacent rotary grooves 27, 27 has the minimum thickness (M) set to a value smaller than that shown in FIG. 4. The adjacent cutting surfaces 34, 34 overlaps one another at a portion of the minimum thickness (M). Further, in FIG. 5, the inclination angle (A) of the rotary groove 27 is set to a value within a smaller range (about 11 degrees to about 15 degrees) than that of FIG. 4.

Figure 6:
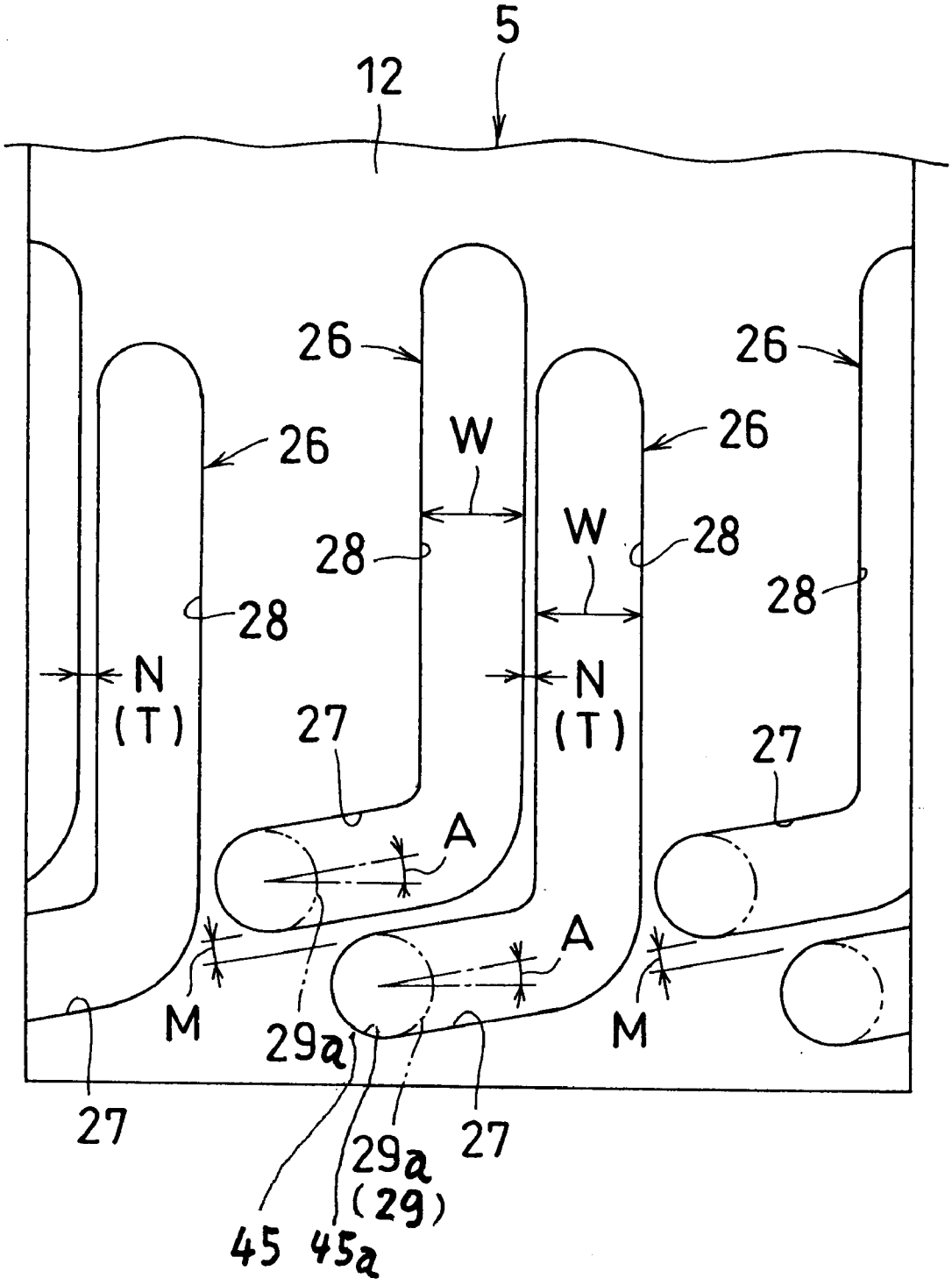
FIG. 6 shows a second modification of the first embodiment and is similar to FIG. 4.

FIG. 6 shows a second modification of the first embodiment and is similar to FIG. 4. In this case, the clamp rod 5 has the lower slide portion 12 provided with four guide grooves 26. A pair of the adjacent guide grooves 26, 26 and the corresponding engaging balls 29 are displaced not only peripherally of the clamp rod 5 but also axially thereof. And the partition wall between a pair of the adjacent rotary grooves 27, 27 has the minimum thickness (M) set to a value smaller than the groove width (W). The partition wall between a pair of the adjacent straight grooves 28, 28 has a minimum thickness (N) set to a value smaller than the groove width (W). Additionally, the latter minimum thickness (N) is set to a value smaller than that of the former minimum thickness (M). Thus the partition wall between the adjacent guide grooves 26, 26 has a minimum thickness (T) set to a value smaller than the groove width (W) and the diameter of the engaging ball 29.

The first embodiment and its modifications can be modified as follows.

It is possible to provide the through holes 31 which rotatably support the engaging balls 29, in the barrel portion 3*c* of the housing 3 and the like instead of providing them in the support cylinder 13 (lower end wall 3*b*) as exemplified.

The inner peripheral surface of the sleeve 35 may be provided with a U-shaped groove or an arcuate groove instead of the exemplified V-shaped groove 36. Further, it may be a straight inner peripheral surface. With the straight inner peripheral surface, in order to inhibit the vertical movement of the sleeve 35 with respect to the engaging balls 29, it is considered to provide a snap ring or the like stopper between the inner wall 13*a* of the support cylinder 13 and the sleeve 35.

The helically formed rotary groove 27 is inclined at the angle (A) preferably within a range of 10 degrees to 30 degrees and more preferably within a range of 11 degrees to 20 degrees.

Figure 9:
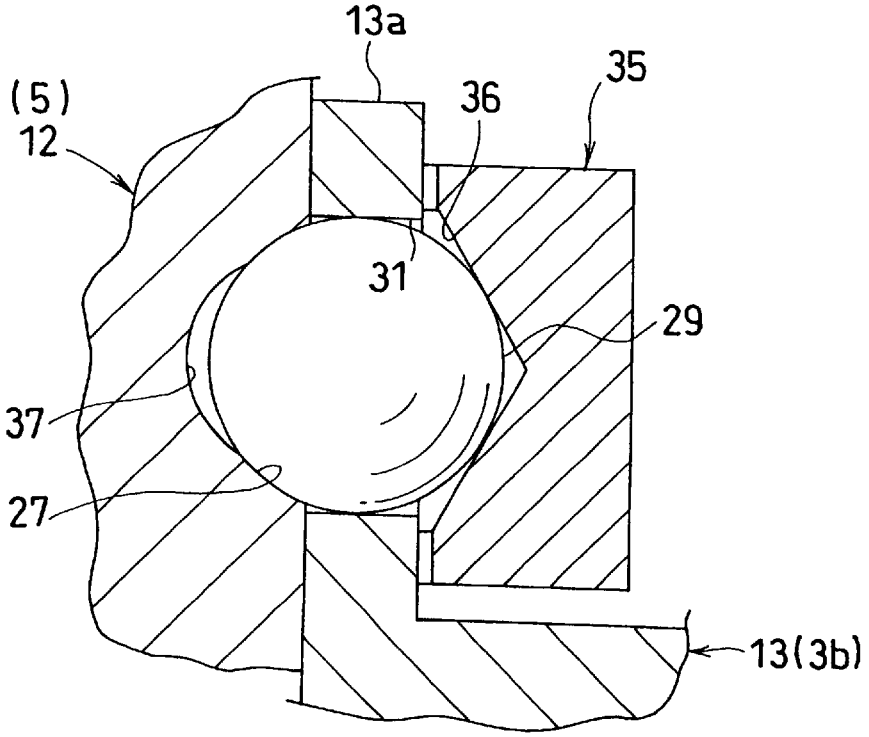
Figure 10:
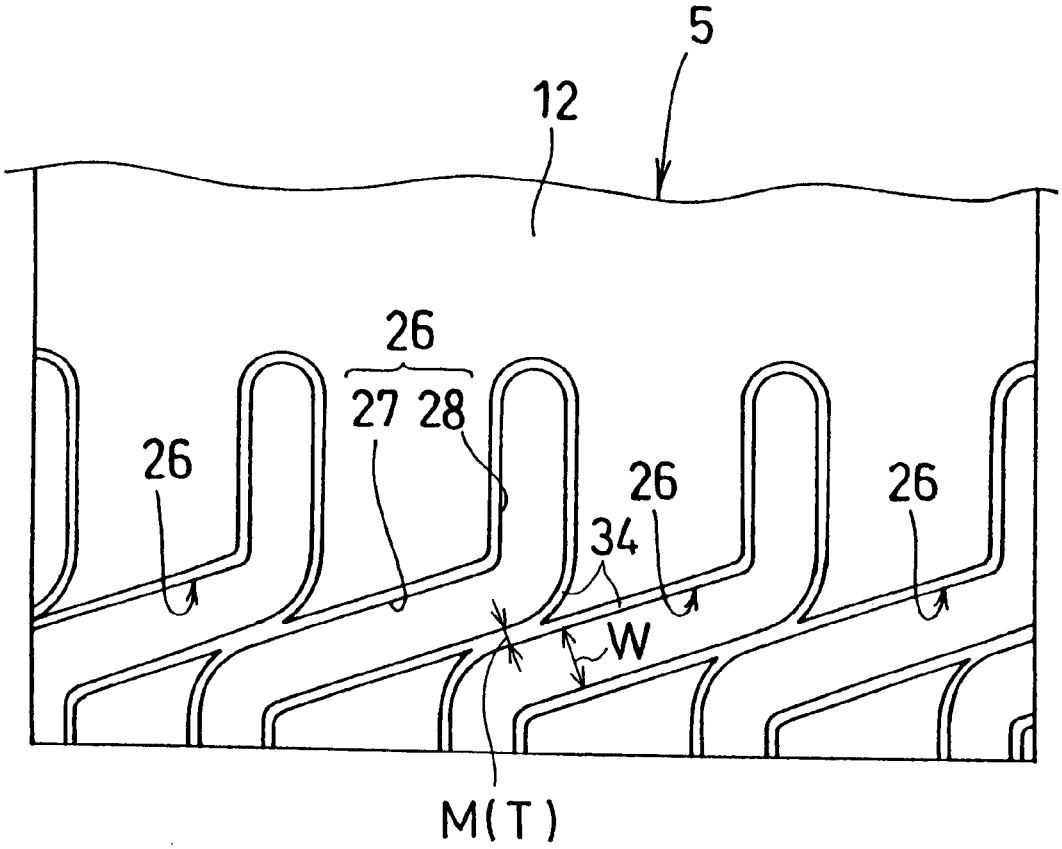
Figure 11:
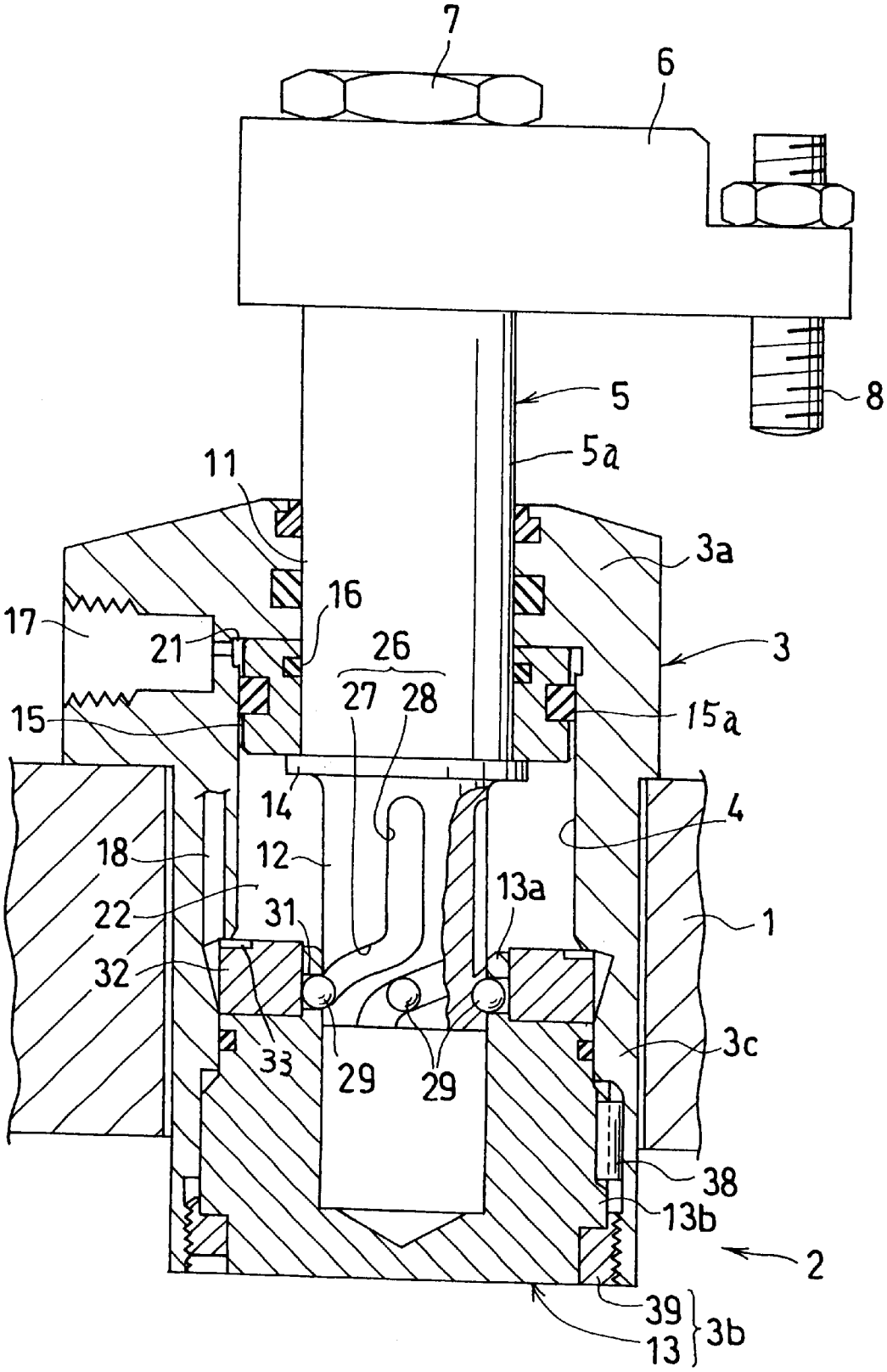
FIG. 11 shows a clamp according to a third embodiment of the present invention and is similar to FIG. 7.
Figure 12:
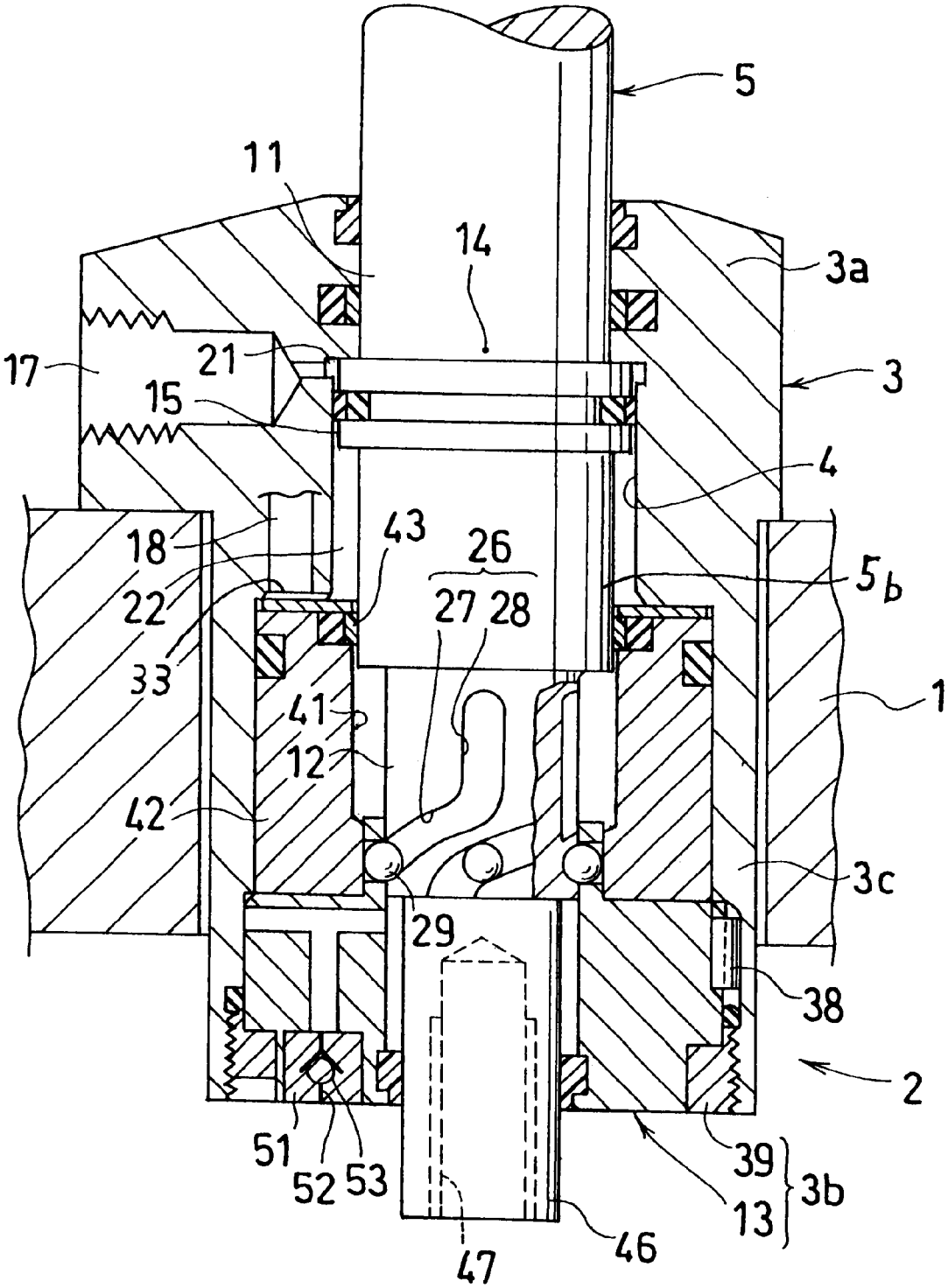
FIG. 12 shows a first modification of the third embodiment and is similar to FIG. 11.
Figure 13:
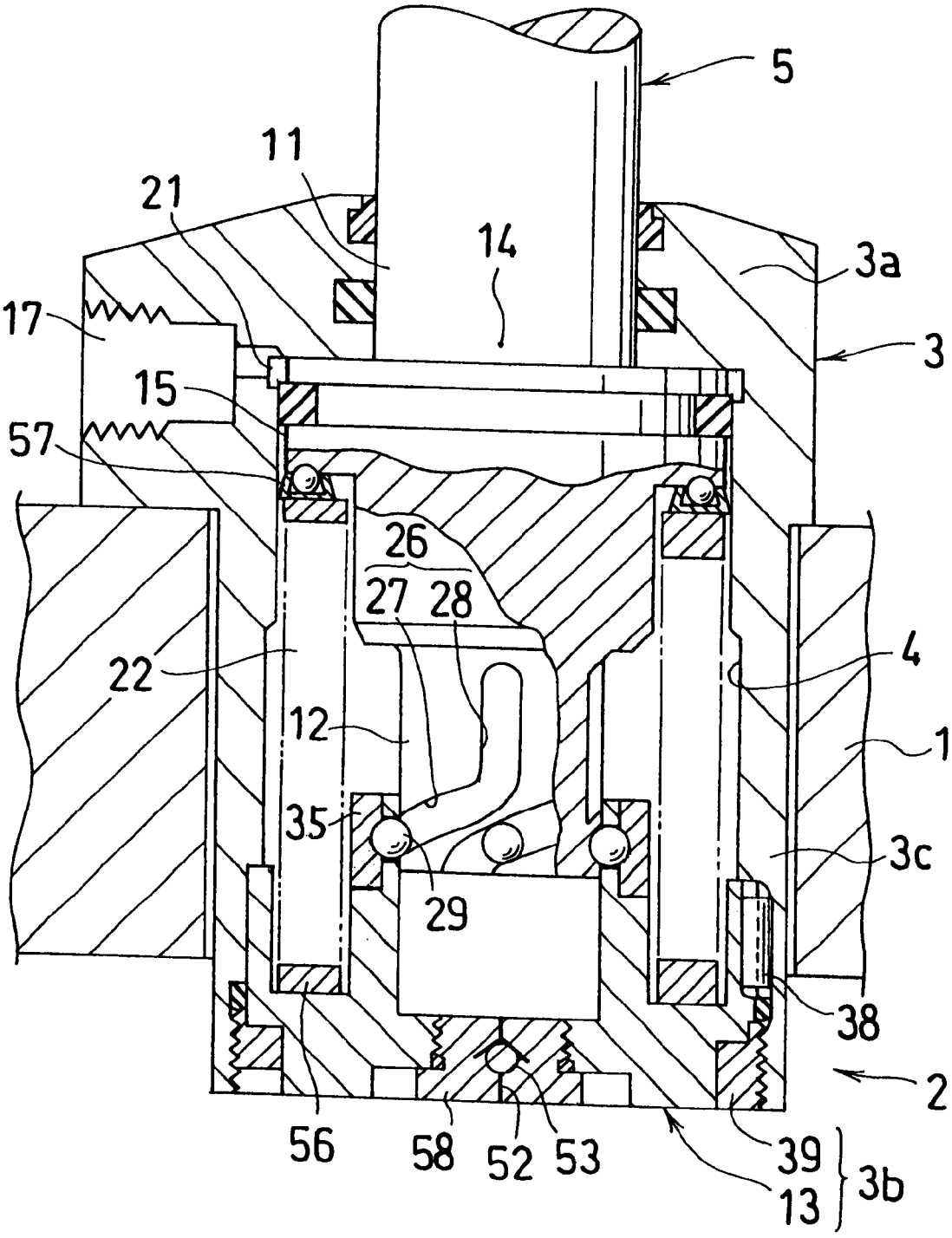
FIG. 13 shows a second modification of the third embodiment and is similar to FIG. 11.
Figure 14:
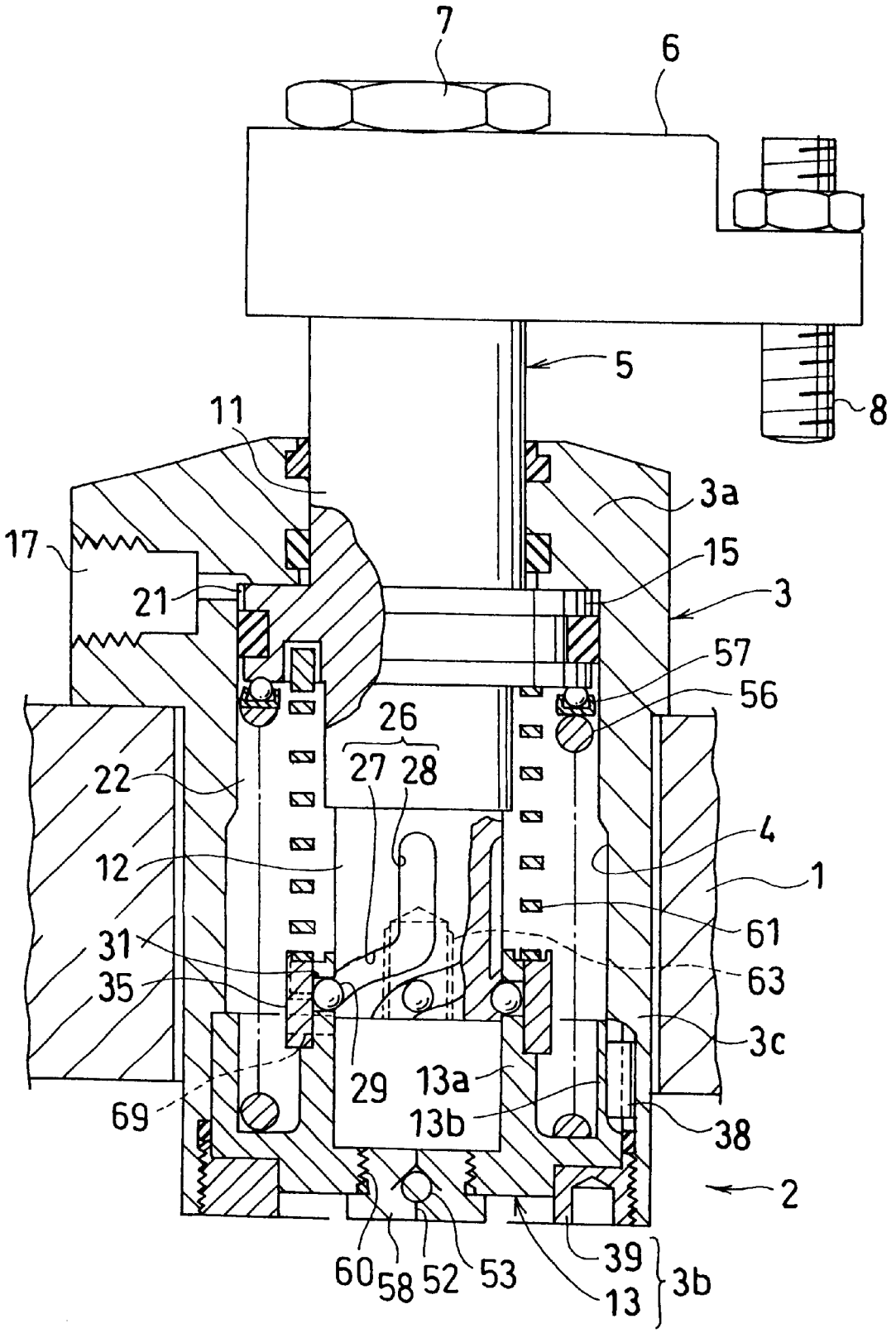
FIG. 14 shows a clamp according to a fourth embodiment of the present invention and is similar to FIG. 13.
Figure 15:
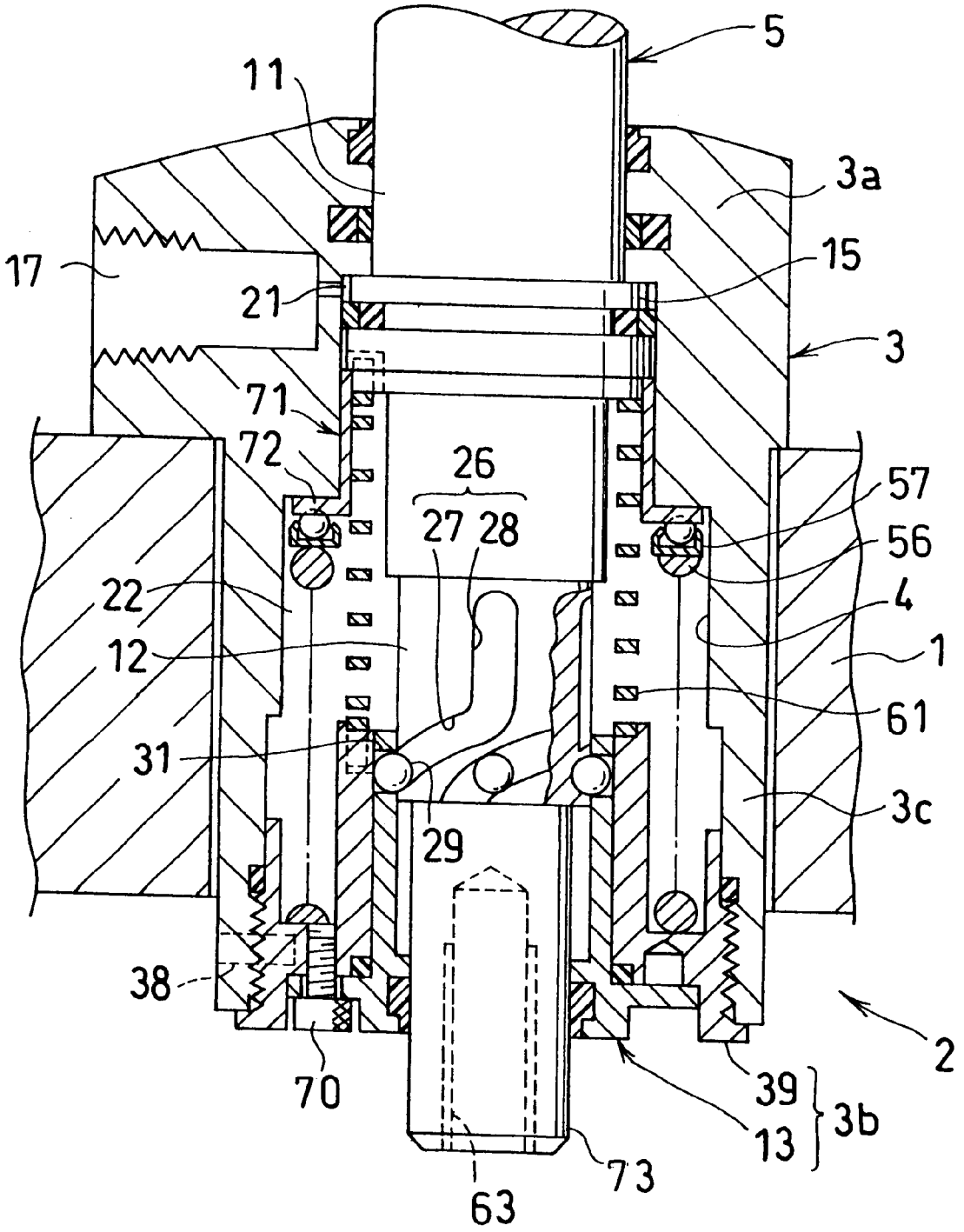
FIG. 15 shows a modification of the fourth embodiment and is similar to FIG. 14.

FIGS. 7 to 10 show a second embodiment and FIGS. 11 to 13 illustrate a third embodiment. Further, FIGS. 14 and 15 show a fourth embodiment. In these separate embodiments, the members similar to the constituent members in the first embodiment are, in principle, designated by the same characters.

Figure 7:
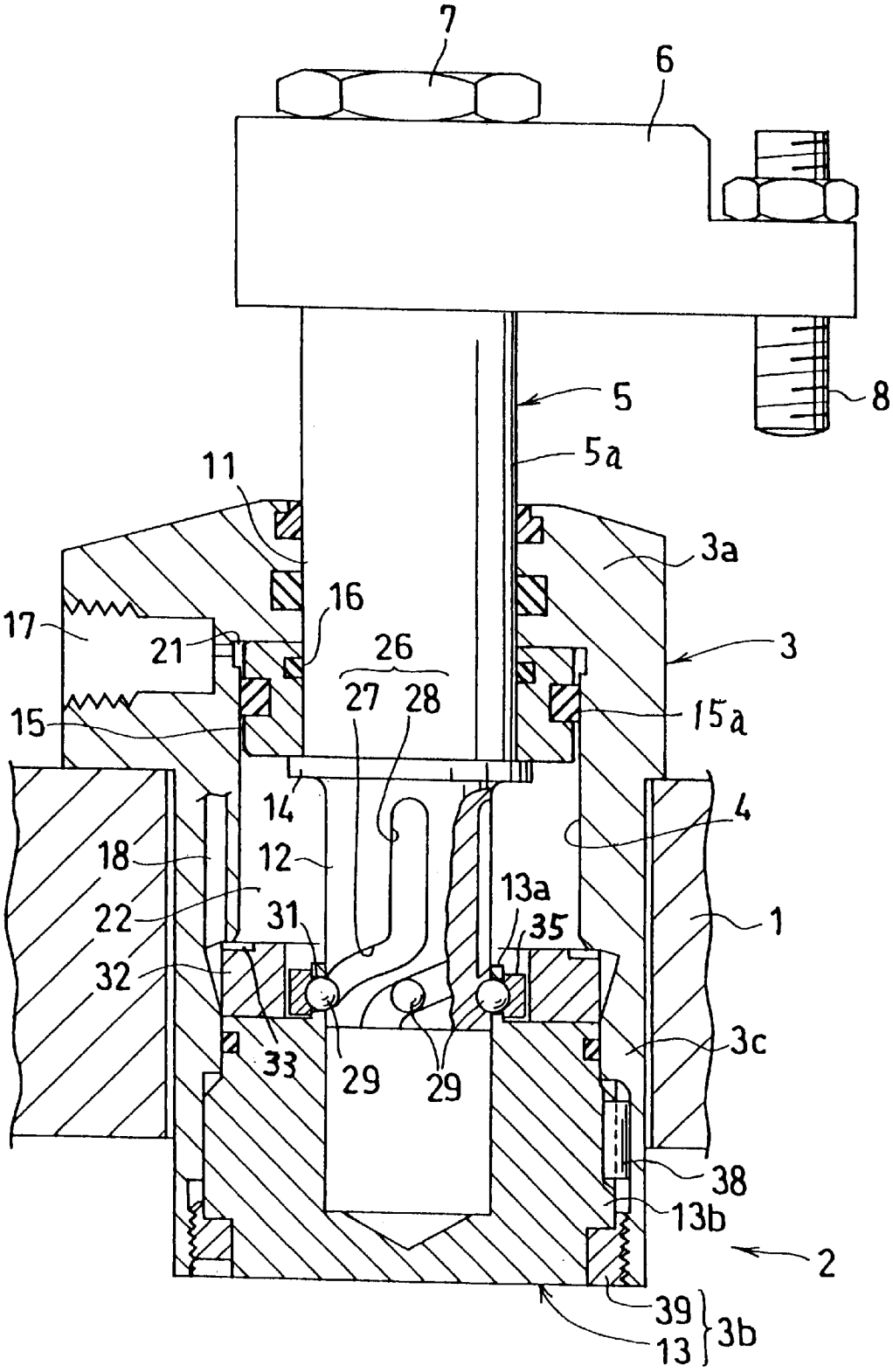
FIGS. 7 to 10 show a second embodiment of the present invention.
Figure 8:
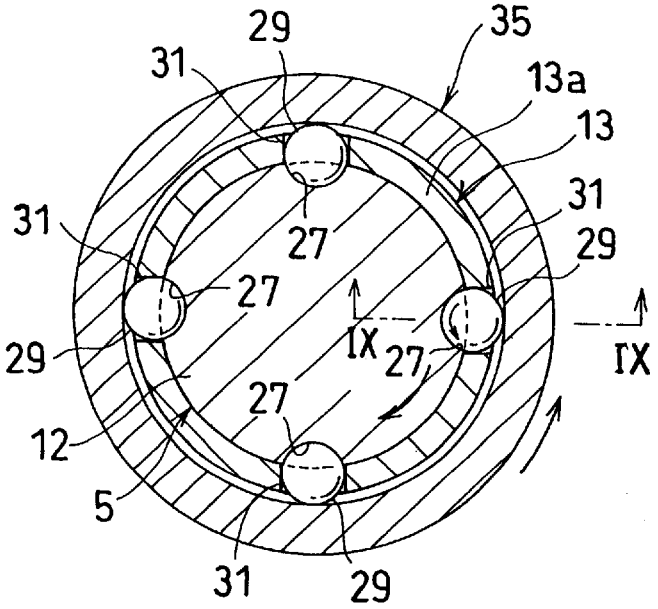

In the second embodiment shown in FIGS. 7 to 10, FIG. 7 is a partial sectional view of the rotary clamp 2 when seen in elevation and is similar to FIG. 1. FIG. 8 is a sectional view of the rotary mechanism provided in the clamp 2 when seen in plan and is similar to FIG. 2. FIG. 9 is an enlarged view of an essential portion in FIG. 7 and corresponds to a sectional view when seen along a line IX—IX in FIG. 8 in a direction indicated by arrows. FIG. 10 is an enlarged and developed view of the lower slide portion 12 provided in the clamp rod 5 of the clamp 2.

The second embodiment is different from the first embodiment on the following points.

The driving means for the clamp rod 5 is formed into a double-acting system. More specifically, pressurized oil for clamping is supplied to and discharged from the first chamber 21 provided upwards of the piston 15, through a pressurized oil supply and discharge port 17 for clamping. Further, pressurized oil for unclamping is supplied to and discharged from the second chamber 22 provided downwards of the piston 15, through a pressurized oil supply and discharge port for unclamping (not shown) and the oil passage 18.

Outside upper and lower opposite sides of another sealing member 15*a* attached to an outer periphery of the piston 15 in fitting relationship, there are formed relatively large fitting gaps between the outer peripheral surface of the piston 15 and the cylindrical hole 4. This enables the housing 3 to smoothly support the clamp rod 5 with a good accuracy at vertical two portions of the upper slide portion 11 and the lower slide portion 12.

The lower slide portion 12 has the outer peripheral surface provided with four guide grooves 26 peripherally at substantially the same spacing. Likewise the first embodiment, each of the guide grooves 26 comprises the helical rotary groove 27 and the straight groove 28 which is in upward continuity with the rotary groove 27. However, the rotary groove 27 has a lower portion opened to an under surface of the clamp rod 5 through a vertically extending groove (designated by no numeral). The engaging ball 29 can be inserted into the guide groove 26 through the opening.

Likewise the first embodiment, as for the adjacent guide grooves 26, 26, the partition wall is minimum in thickness between a lower portion of a right rotary groove 27 and an upper portion of a left rotary groove 27 in FIG. 10. The partition wall has the minimum thickness (M) set to a value smaller than the groove width (W) of the guide groove 26 and the diameter of the engaging ball 29.

The engaging balls 29 fitted into the respective guide grooves 26 are rotatably supported by the four through holes 31 provided in the upper portion of the inner wall 13*a* of the support cylinder 13. The sleeve 35 is externally fitted over these four engaging balls 29 rotatably around the axis. The rotary groove 27 is concaved to provide an arcuate recess 37. Every engaging ball 29 is rollable in the rotary groove 27 at two vertical outside positions of the recess 37.

A cylindrical spacer 32 is attached between a lower portion of a peripheral wall of the second chamber 22 for unclamping and an upper surface of the support cylinder 13. The spacer 32 has an upper surface formed with a restricting groove 33. The restricting groove 33 controls supply amount of the pressurized oil from the oil passage 18 to the second chamber 22. A though hole or the like is employable instead of the groove 33.

The support cylinder 13 is pushed and fixed to the housing barrel portion 3*c* by the lock member 39 made of an externally threaded cylinder.

Likewise the first embodiment, the lower slide portion 12 has the outer diameter set to a value smaller than that of the outer diameter of the upper slide portion 11. This shortens the lead of the helical rotary groove 27 to result in reducing the rotation stroke of the clamp rod 5.

FIG. 11 shows a third embodiment of the present invention. FIG. 11 is a partial sectional view of the rotary clamp when seen in elevation and is similar to FIG. 7.

The third embodiment of FIG. 11 is distinct from the structure shown in FIG. 7 merely on the following point.

The sleeve 35 in FIG. 7 is omitted. And the spacer 32 prevents the removal of the engaging balls 29 supported by the inner wall 13*a* of the support cylinder 13.

FIG. 12 shows a first modification of the third embodiment and is similar to FIG. 11.

The first modification of FIG. 12 differs from the structure of FIG. 11 on the following points.

The piston 15 is integrally formed with the clamp rod 5. Downwardly provided between the piston 15 and the lower end wall 3*b* are the second chamber 22 and a cylinder hole 41 for rejecting receipt of pressure in the mentioned order. The cylinder hole 41 is defined by an inner peripheral surface of an adaptor cylinder 42. The clamp rod 5 has an enclosed portion 5*b* inserted into the cylinder hole 41 hermetically by a sealing member 43.

Owing to the above arrangement, an upward force which acts on the clamp rod 5 upon unclamping is only an oil pressure force acting on an annular sectional area which appears by deducting a cross sectional area of the enclosed portion 5*b* from a cross sectional area of the second chamber 22. Therefore, any excessive force does not act on the rotary grooves 27 and the engaging balls 29.

It is sufficient if the enclosed portion 5*b* has a diameter set to a value smaller than that of a diameter of the second chamber 22. Here it is set to substantially the same value as that of the diameter of the upper slide portion 11 of the clamp rod 5.

It is preferable to set the diameter of the enclosed portion 5*b* to a value larger than that of the diameter of the upper slide portion 11. In this case, the upward force which acts on the clamp rod 5 upon unclamping can be further decreased to result in extending the service lifetime of the rotary groove 27 and the engaging ball 29.

Likewise FIG. 11, a relatively large fitting gap is formed between the outer peripheral surface of the piston 15 and an upper half portion of the cylindrical hole 4 as well as between the enclosed portion 5*b* of the clamp rod 5 and the cylinder hole 41.

The oil passage 18 has a lower end surface formed with the restricting groove 33.

A rod 46 which detects the clamping condition and the unclamping condition projects downwards of the lower slide portion 12. The rod 46 is formed with an internally threaded hole 47 which engages with a detected member (not shown) in screw-thread fitting. A limit switch or the like sensor (not shown) opposes to the detected member.

Besides, the support cylinder 13 has the lower portion into which a plug 51 is hermetically fitted. A breathing passage 52 provided within the plug 51 communicates an interior space of the cylinder hole 41 with an exterior area. The breathing passage 52, as shown in a schematic view, is provided with a trap valve 53 which comprises a check valve of spring type.

The trap valve 53 functions as follows.

When the clamp rod 5 has ascended to expand the interior space of the cylinder hole 41, checking function of the trap valve 53 prevents the cutting lubricant and the like present in the exterior atmosphere from invading into the cylinder hole 41. Further, when the clamp rod 5 has descended to contract the interior space of the cylinder hole 41, the trap valve 53 smoothly discharges to the exterior area the pressurized oil which has invaded from the second chamber 22 to the interior space of the cylinder hole 41.

FIG. 13 shows a second modification of the third embodiment and is similar to FIG. 11. FIG. 13 shows the rotary clamp 2 of single-acting and spring-return type, which is different from the structure shown in FIG. 11 on the following points.

The piston 15 is formed integrally with the clamp rod 5. A return spring 56 for unclamping is attached within the second chamber 22 formed between the support cylinder 13 and the piston 15. The return spring 56 urges the clamp rod 5 upwards. Here the return spring 56 is composed of a compressed coil spring. The spring 56 has a lower end brought into contact with the support cylinder 13 and has an upper end received by the piston 15 through a thrust ball bearing 57.

In addition, the sleeve 35 is rotatably and externally fitted over the engaging balls 29.

The trap valve 53 is attached to a bolt 58 which engages with a mid portion of the support cylinder 13 in screw-thread fitting.

FIG. 14 illustrates a fourth embodiment of the present invention. FIG. 14 is a partial sectional view of the rotary clamp 2 when seen in elevation and is similar to FIG. 13.

The fourth embodiment of FIG. 14 is distinct from the structure of FIG. 13 on the following points.

The engaging balls 29 are prevented from removing, by the sleeve 35 externally fitted over the inner wall 13*a* of the support cylinder 13. The sleeve 35 is fixed to the inner wall 13*a* through a pin 69.

A torsion spring (resilient member) 61 composed of a coil spring is attached in an annular gap between the clamp rod 5 and the return spring 56. The torsion spring 61 has an upper end connected to the clamp rod 5 through the piston 15. Further, the torsion spring 61 has a lower end connected to the sleeve 35, thereby connecting the lower end of the torsion spring 61 to the housing 3 through the support cylinder 13.

The torsion spring 61 urges the clamp rod 5 (and the arm 6) to the rotation and retreat position shown in FIG. 14. A preload is applied to the torsion spring 61, for example, according to the following procedures.

The clamp rod 5 has an upper end surface opened to provide an internally threaded hole (not shown). By utilizing the internally threaded hole, the clamp rod 5 is twisted by a predetermined angle in the clockwise direction when seen in plan and the torsion spring 61 makes its urging force act in the counter-clockwise direction when seen in plan.

The rotary clamp 2 is, for instance, assembled according to the following procedures.

In advance, the clamp rod 5, the support cylinder 13, the torsion spring 61 and the return spring 56 are provisionally assembled. Speaking it in more detail, each of the engaging balls 29 is inserted into a predetermined rotation position (for example, the rotation position shown in FIG. 14) of every guide groove 26. In that state, the support cylinder 13 and the sleeve 35 are formed into an integral structure by the pin 69.

Next, the bolt 58 is removed from a female screw 60 of the support cylinder 13. An operation bolt (not shown) is inserted into the female screw 60. The operation bolt is fitted into a threaded hole 63 of the clamp rod 5. The operation bolt is rotated to pull the clamp rod 5 toward the support cylinder 13, thereby compressing the return spring 56 (and the torsion spring 61) by a predetermined amount.

Subsequently, with the arm 6 removed from the clamp rod 5, the clamp rod 5 and the support cylinder 13 are inserted into the housing 3 from below. The support cylinder 13 is attached to the lower portion of the housing 3 through the pin 38 so that it does not rotate. This can automatically determine the rotation phase of the clamp rod 5. Thereafter, the lock member 39 made of a male screw fixes the support cylinder 13 to the housing 3.

The rotary clamp 2 works as follows.

In a state shown by FIG. 14, the pressurized oil in the first chamber 21 is discharged. The clamp rod 5 rotates in the counter-clockwise direction when seen in plan by the torsion spring 61 and goes up through the return spring 56.

When switching over the rotated and retreated clamp 2 to the clamping condition, the pressurized oil is supplied to the first chamber 21, thereby enabling the piston 15 to push down the clamp rod 5. Then the piston 15 compresses the return spring 56 and at the same time the clamp rod 5 descends along the rotary grooves 27 while rotating in the clockwise direction when seen in plan to enhance a torsional force of the torsion spring 61. Subsequently, the piston 15 further compresses the return spring 56 and the clamp rod 5 descends straightly along the straight grooves 28. This switches over the clamp rod 5 to the clamping position (not shown).

When switching over the clamp rod 5 from the clamping condition to the rotated and retreated condition in FIG. 1, the pressurized oil in the first chamber 21 is discharged.

Then, first, the piston 15 and the clamp rod 5 straightly go up along the straight grooves 28 through the urging force of the return spring 56. Subsequently, the piston 15 and the clamp rod 5 ascend while strongly rotating in the counter-clockwise direction by a force resultant from a component force of rotation produced by the urging force of the return spring 56, and the urging force of the torsion spring 61. The clamp rod 5 and the arm 6 are smoothly switched over to the rotation and retreat position.

The fourth embodiment of FIG. 14 offers the following advantages.

When performing an unclamping rotation, the clamp rod 5 strongly rotates to the rotation and retreat position by the force resultant from the component force of rotation produced by the urging force of the return spring 56, and the urging force of the torsion spring (resilient member) 61. Consequently, in order to smoothly rotate the clamp rod 5, a gradient of the rotary groove 27 need not be increased and therefore the rotation stroke of the clamp rod 5 is small. This results in reducing the height of the rotary clamp 2 and besides decreases the consumption amount of the pressurized oil when it is driven for clamping.

Further, the return spring 56 is externally fitted onto the clamp rod 5 with an annular gap interposed therebetween. The torsion spring 61 is attached in the annular gap. Accordingly, by effectively utilizing a redundant space within the housing 3, the rotary clamp 2 can be made more compact.

FIG. 15 shows a modification of the fourth embodiment and is similar to FIG. 14.

The modification of FIG. 15 supplies to the clamp 2, pressurized oil of a higher pressure than the structure of FIG. 14 and is distinguished from the structure of FIG. 14 on the following points.

The horizontal positioning pin 38 is provided between the lock member 39 made of the male screw and a lower portion of the housing barrel portion 3*c*. The torsion spring 61 is attached between the lock member 39 and the piston 15. The support cylinder 13 is secured to the lock member 39 through a plurality of bolts 70 (only one of which is shown here). A spring retainer 71 is brought into contact with an under surface of the piston 15 from below. The return spring 56 is attached between a lower flange 72 of the spring retainer 71 and the lock member 39 through the thrust ball bearing 57.

Downwardly projecting from the lower slide portion 12 is a rod 73 which detects the clamping condition and the unclamping condition. The rod 73 is formed with the threaded hole 63. The threaded hole 63 engages with a detected member (not shown) in screw-thread fitting. The detected member opposes to a limit switch or the like sensor (not shown).

The fourth embodiment and its modification can be modified as follows.

The resilient member which urges the clamp rod 5 peripherally may be a cylindrical or columnar spring, rubber or the like instead of the exemplified coiled torsion spring 61. The resilient member may be attached in an interior space of the clamp rod 5.

The piston 15 may be formed separately from the clamp rod 5 instead of integrally therewith.

The respective embodiments and modifications can be further modified as follows.

The clamp rod 5 is preferably provided with three or four guide grooves 26, but it may be provided with two guide grooves. Further, at least five guide grooves may be provided. And the guide groove 26 may have a groove in the shape of a cam instead of the exemplified helical rotary groove 27.

It is sufficient if the minimum thickness (T) of the partition wall between the adjacent guide grooves 26, 26 has a value smaller than the diameter of the engaging ball 29. In consequence, the minimum thickness (T) can be made to have a value larger than the groove width (W) of the guide groove 26.

Besides, the engaging member which is fitted into the guide groove 26 may be a columnar pin or the like instead of the exemplified ball 29.

The pressurized fluid which is supplied to and discharged from the first chamber 21 or the second chamber 22 may be other kinds of liquid, and air or the like gas, instead of the exemplified pressurized oil.

On performing clamping operation, the clamp rod 5 rotates in the clockwise direction when seen in plan. Instead, on performing the clamping operation, it may rotate in the counter-clockwise direction when seen in plan. Further, it is a matter of course that the rotation angle of the clamp rod 5 may be set to a desired angle, for example, such as 90 degrees, 60 degrees and 45 degrees.

What is claims is:

1. A rotary clamp comprising:

a housing (3) having a first end and a second end in a direction of an axis;

a clamp rod (5) having an outer peripheral portion, the clamp rod (5) being inserted into the housing (3) rotatably around the axis and being moved for clamping in a direction from the first end to the second end;

guide grooves (26) formed in the outer peripheral portion of the clamp rod (5) peripherally in plural number, each of the guide grooves (26) having a width (W) and comprising a rotary groove (27) and a straight groove (28) which are provided in continuity with each other in a direction from the second end to the first end, the rotary grooves (27) as well as the straight grooves (28) being arranged in parallel with one another;

a plurality of engaging members (29) supported by the housing (3) so as to be fitted into the guide grooves (26), respectively;

a partition wall formed between the adjacent guide grooves (26), (26); and the partition wall having a minimum thickness (T) set to a value smaller than the width (W) of the guide groove (26).

2. The rotary clamp as set forth in claim 1, wherein each of the engaging members (29) is formed from a ball.

3. The rotary clamp as set forth in claim 2, wherein the housing (3) has through holes (31), and the engaging balls (29) are rotatably supported by the through holes (31), respectively, a sleeve (35) being rotatably and externally fitted over these engaging balls (29).

4. The rotary clamp as set forth in claim 2, wherein at least three guide grooves (26) are provided.

5. The rotary clamp as set forth in claim 2, wherein the guide grooves (26) are arranged peripherally of the clamp rod (5) at substantially the same spacing.

6. The rotary clamp as set forth in claim 2, wherein the clamp rod (5) has a second end portion provided with the guide grooves (26) and the rotary groove (27) of every guide groove (26) has a second end portion provided with a stopper wall (45) which receives the engaging ball (29), the stopper wall (45) having a receiving surface (45*a*) made to fit with the engaging ball (29).

7. The rotary clamp as set forth in claim 2, wherein an annular piston (15) is inserted into the housing (3) axially movably and the clamp rod (5) is inserted into the piston (15), a radial bearing (24) being arranged between these piston (15) and clamp rod (5).

8. The rotary clamp as set forth in claim 1, wherein at least three guide grooves (26) are provided.

9. The rotary clamp as set forth in claim 1, wherein the guide grooves (26) are arranged peripherally of the clamp rod (5) at substantially the same spacing.

10. The rotary clamp as set forth in claim 1, wherein the clamp rod (5) has a second end portion provided with the guide grooves (26) and the rotary groove (27) of every guide groove (26) has a second end portion provided with a stopper wall (45) which receives the engaging member or ball (29), the stopper wall (45) having a receiving surface (45*a*) made to fit with the engaging member or ball (29).

11. The rotary clamp as set forth in claim 1, wherein an annular piston (15) is inserted into the housing (3) axially movably and the clamp rod (5) is inserted into the piston (15), a radial bearing (24) being arranged between these piston (15) and clamp rod (5).

12. A rotary clamp comprising:

a housing (3) having a first end and a second end in a direction of an axis;

a clamp rod (5) having an outer peripheral portion, the clamp rod (5) being inserted into the housing (3) rotatably around the axis and being moved for clamping in a direction from the first end to the second end;

guide grooves (26) formed in the outer peripheral portion of the clamp rod (5) peripherally in plural number, each of the guide grooves (26) comprising a rotary groove (27) and a straight groove (28) which are provided in continuity with each other in a direction from the second end to the first end, the rotary grooves (27) as well as the straight grooves (28) being arranged in parallel with one another;

a plurality of engaging balls (29) supported by the housing (3) so as to be fitted into the guide grooves (26), respectively;

a partition wall formed between the adjacent guide grooves (26), (26); and the partition wall having a minimum thickness (T) set to a value smaller than a diameter (D) of the engaging ball (29).

13. The rotary clamp as set forth in claim 12, wherein the housing (3) has through holes (31), and the engaging balls (29) are rotatably supported by the through holes (31), respectively, a sleeve (35) being rotatably and externally fitted over these engaging balls (29).

14. The rotary clamp as set forth in claim 12, wherein at least three guide grooves (26) are provided.

15. The rotary clamp as set forth in claim 12, wherein the guide grooves (26) are arranged peripherally of the clamp rod (5) at substantially the same spacing.

16. The rotary clamp as set forth in claim 12, wherein the clamp rod (5) has a second end portion provided with the guide grooves (26) and the rotary groove (27) of every guide groove (26) has a second end portion provided with a stopper wall (45) which receives the engaging ball (29), the stopper wall (45) having a receiving surface (45*a*) made to fit with the engaging ball (29).

17. The rotary clamp as set forth in claim 12, wherein an annular piston (15) is inserted into the housing (3) axially movably and the clamp rod (5) is inserted into the piston (15), a radial bearing (24) being arranged between these piston (15) and clamp rod (5).

* * * * *